United States Patent [19]

Liu et al.

[11] 4,238,229

[45] Dec. 9, 1980

[54] FE-BASED LONG RANGE ORDERED ALLOYS

[75] Inventors: Chain T Liu; Henry Inouye; Anthony C. Schaffhauser, all of Oak Ridge, Tenn.

[73] Assignee: The United States of America as represented by the United States Department of Energy, Washington, D.C.

[21] Appl. No.: 47,444

[22] Filed: Jun. 11, 1979

[51] Int. Cl.[3] ..... C22C 38/08

[52] U.S. Cl. ..... 75/122; 75/123 J; 75/123 K; 75/134 F; 75/170; 148/11.5 R; 148/11.5 N; 148/12 R; 148/12 B; 148/31; 148/32

[58] Field of Search ..... 75/122, 123 J, 123 K, 75/134 F, 170; 148/11.5 R, 11.5 N, 12 R, 12 B, 31, 32

[56] References Cited

U.S. PATENT DOCUMENTS 4,144,059 3/1979 Liu et al. ..... 75/122

*Primary Examiner*—R. Dean

*Attorney, Agent, or Firm*—James E. Denny; Stephen D. Hamel; Allen H. Uzzell

[57] ABSTRACT

Malleable long range ordered alloys having high critical ordering temperatures exist in the $V(Co,Fe)_3$ and $V(Co,Fe,Ni)_3$ system having the composition comprising by weight 22–23% V, 35–50% Fe, 0–22% Co and 19–40% Ni with an electron density no greater than 8.00. Excellent high temperature properties occur in alloys having compositions comprising by weight 22–23% V, 35–45% Fe, 0–10% Co, 25–35% Ni; 22–23% V, 28–33% Ni and the remainder Fe; and 22–23% V, 19–22% Ni, 19–22% Co and the remainder Fe. The alloys are fabricable by casting, deforming and annealing for sufficient time to provide ordered structure.

11 Claims, 3 Drawing Figures

FE-BASED LONG RANGE ORDERED ALLOYS

This invention is a result of a contract with the United States Department of Energy.

BACKGROUND OF THE INVENTION

It relates in general to long range ordered alloys of the transition metals V, Fe, Ni, and Co and more specifically to long range ordered alloys of the $AB_3$ type.

Long range ordered alloys are like intermetallic compounds whose atoms are arranged in order below a critical ordering temperature, $T_C$. The term "long range order" refers to alloys having ordered structure extending for a distance of more than about 100 atoms in a single domain. The principal advantage of long range ordered alloys is their strength and stability at high temperatures. At temperatures below $T_C$ the ordered structure of the alloy has the lowest free energy. An ordered alloy can experience temperatures below $T_C$ for indefinite periods without undergoing significant compositional or phase changes. Above $T_C$ however, the tensile strength of ordered alloys is substantially reduced due to the disordering effect. In the prior art the principal disadvantage associated with long range ordered alloys has been their extreme brittleness. As a result, long range ordered alloys had not been used as structural material for high temperature applications. One notable exception is the ductile long range ordered alloy described in commonly assigned U.S. Pat. No. 4,144,059, issued Mar. 13, 1979, in the name of Chain T. Liu and Henry Inouye entitled "Ductile Long Range Ordered Alloy with High Critical Ordering Temperature and Wrought Articles Fabricated Therefrom." The alloys described in U.S. Pat. No. 4,144,059 were Co-based alloys having the nominal composition $V(Co,Fe)_3$ or $V(Co,Fe,Ni)_3$ comprising by weight 22–23% V, 14–30% Fe and the remainder Co or Co and Ni with an electron density no greater than 7.85. With this electron density limitation, the alloy, which contained no more than 23% V and 30% Fe could contain no more than about 10% by weight Ni and no less than about 37% by weight Co. The alloys of U.S. Pat. No. 4,144,059 are expensive due to the high cost of the required cobalt. The alloys are also of limited utility for nuclear applications because of the high neutron absorption cross section resulting from the cobalt content. A ductile long range ordered alloy having lower neutron absorption cross sections would be very attractive for structural components such as fuel-cladding for fast and thermal reactors and for a first wall material in controlled thermonuclear reactors.

SUMMARY OF THE INVENTION

It is an object of this invention to provide a ductile long range ordered iron-based alloy of the $AB_3$ type having a lower neutron absorption cross section than the alloy of U.S. Pat. No. 4,144,059.

It is a further object of this invention to provide ductile long range ordered iron-based alloys having higher iron and lower cobalt contents than the alloys of U.S. Pat. No. 4,144,059.

It is a further object to provide a novel use of long range ordered Fe-based alloys and a fabrication method which employs their newly discovered properties in the ordered state to provide wrought articles having excellent mechanical properties and stabilities at high temperatures.

It is a further object to provide improvement in an apparatus having a component exposed to a temperature of greater than 300° C.

In its composition aspects this invention comprises a long range ordered alloy having a critical ordering temperature greater than about 600° C., a room temperature ultimate tensile strength greater than 1,000 MPa, and a room temperature tensile elongation greater than 30%, said alloy having the nominal $V(Fe,Ni)_3$ or $V(Fe,Ni,Co)_3$ composition with an electron density no greater than about 8.00 and comprising by weight 22–23% V, 35–50% Fe, 0–22% Co, and 19–40% Ni. The maximum combination of high temperature creep resistance, strength, and ductility should occur in the alloy comprising by weight 22–23% V, 35–45% Fe, 0–10% Co and 25–35% Ni. In its method aspects, this invention comprises the method of fabricating wrought articles from the long range ordered alloy of this invention comprising by weight 22–23% V, 35–50% Fe, 0–22% Co, and 19–40% Ni and having the nominal $V(Fe,Ni)_3$ or $V(Fe,Ni,Co)_3$ composition with an electron density no greater than about 8.00, said method comprising the steps of (a) fabricating said alloy at a temperature either above or below the critical ordering temperature of said alloy to provide a wrought article, (b) annealing said wrought article for sufficient time to provide long range ordered structure in said wrought article. Because of the excellent strength and ductility of the alloy in its ordered state, the fabrication, i.e., deformation, process can be performed at temperatures well below the critical ordering temperature.

In its article aspects, this invention comprises a wrought or drawn article of manufacture in the form of plate, sheet, rod, wire, foil and the like having the long range ordered alloy compositions of this invention. In its apparatus aspects this invention comprises an improvement in apparatus having a component exposed to a temperature greater than 300° C. in which said component comprises the alloy compositions of this invention.

DETAILED DESCRIPTION

Figure 1:
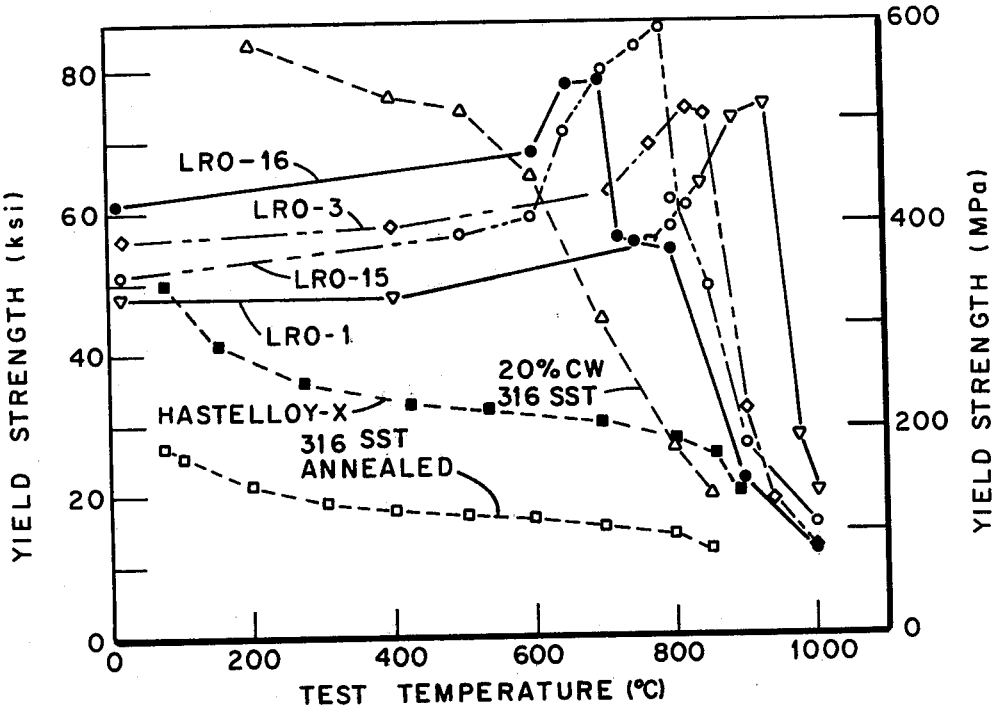
FIG. 1 is a graph showing the yield strength of alloys of this invention as compared to 316 stainless steel, Hastelloy-X, and Co-based long range ordered alloys of U.S. Pat. No. 4,144,059.

One aspect of this invention is the discovery that ductile Fe-based long range ordered alloys of the $AB_3$ type exist in the V-Fe-Ni system and in the V-Fe-Ni-Co system containing no more than 22 wt.% Co. As described in U.S. Pat. No. 4,144,059, alloys in the V-Co system were known to be ordered, and the replacement of a portion of the Co with Fe resulted in improved ductility. The alloys of the Fe-V system do not demonstrate ordering. It has been found, however, that a portion of the Fe can be replaced with Ni or Ni and Co to result in marked increase in ductility. It was quite unexpected that the alloy containing zero or only small amounts of cobalt would demonstrate ordered structure in combination with excellent mechanical properties. The alloys of this invention have an electron density no greater than about 8.00. Electron density (e/a) is a function of the composition and is equal to the number of electrons per atom outside the inert gas shell. At electron densities below 8.00 the ordered alloys of this invention exhibit face centered cubic ordered structure. At electron densities greater than about 8.00 the ordered alloys of this invention demonstrate a hexagonal close-pack ordered structure, characterized by substantially lower ductility. The ductile cubic ordered structure in the Fe-based ordered alloys of this invention is stable at high e/a ratios, even higher than the 7.85 limit of U.S. Pat. No. 4,144,059. The Fe-based alloys demonstrate improved mechanical properties at lower temperatures than do the Co-based alloys of U.S. Pat. No. 4,144,059.

The alloys of this invention demonstrate highly desirable combination of low neutron absorption cross section, high tensile strength, high yield strength, good tensile elongation, and low evaporation losses, coupled with no brittle phase formation at elevated temperatures. The exceptional ductility of the long range ordered alloys of this invention enables the alloys to be used in conventional metal working fabrication methods such as rolling, drawing, forging, swaging, etc., followed by annealing for sufficient time to provide long range ordered structure characteristic of the alloy composition. The resulting articles, such as plate, sheet, rod, wire, foil and the like, have excellent stability and can be further fabricated into desired configurations by conventional metal working techniques, including deformations performed below the $T_C$ of the alloy composition. The unexpected ductility and high temperature strength of the wrought ordered alloys of this invention make them useful in high temperature applications. The alloys of this invention are particularly useful as structural materials for components of apparatus which are exposed to temperatures in excess of 300° C., for example, in closed-cycle energy systems such as external combustion engines, e.g., Sterling systems, gas-cooled reactors, space power systems, magnetic fusion reactors, and fast breeder reactors which require high strength and creep resistance at elevated temperatures. The low cobalt content of these ductile long range ordered alloys results in a sharp reduction in cost compared to the Co-based U.S. Pat. No. 4,144,059 alloys. The alloys of this invention can have the composition consisting essentially of the specified transition metals, however, it is probable that additional components will be found that further enhance the properties of these alloys. "Consisting essentially of" is defined to include only those components which do not materially affect the strength and ductility of the alloy of its ordered state. The alloys of this invention may consist entirely of V, Fe, Ni and Co in the specified proportions; that is, including only impurities at levels ordinarily associated with the components.

The alloy compositions of this invention are most easily prepared by first melting the appropriate mixture of metals by conventional techniques such as arc melting and then casting into an ingot. The cast alloys can be worked by conventional techniques with rolling being preferred. It is generally preferred that the alloys of this invention be hot worked to break down the as-cast structure, followed by cold work at room temperature. The hot working step can be performed above $T_C$ if desired with 900°–1100° C. being satisfactory. After working, the alloys of this invention are annealed for sufficient time to provide long range ordered structure, with 2–15 hours at 600°–730° C. being generally sufficient. The preferred annealing temperature is about 50°–100° C. below $T_C$.

Table I depicts the $T_C$, e/a and crystalline structure for several atomic compositions of V, Fe, Ni, and Co including the ordered LRO-15, -16, and -17. Corresponding compositions by weight are presented in Table II. The analogous alloy LRO-18, $Fe_3V$, is apparently disordered, at least so far as our tests have shown. As shown in Table I, adding Ni or Ni and Co to the $Fe_3V$ alloy promotes atomic ordering and increases the critical ordering temperature. As the electron density reaches 8.00 the cubic ordered structure is converted to hexagonal close-pack, a brittle ordered structure.

EXAMPLE

Alloys LRO-15 and -16 were prepared by arc melting mixtures of the metallic components and drop casting. Alloy 17 was prepared by electron beam melting and casting. The ingots were wrapped in a molybdenum sheet and then rolled at 1000°–1100° C. followed by a cold roll at room temperature to 0.8 mm thick sheets. The sheets had good quality with no indication of surface or end cracks. Tensile specimens were blanked from the sheets and then heat treated at 600°–1100° C. in vacuum or helium environment. The disordered structure was produced by quenching from 1100° C. The ordered structure was produced by aging at temperatures below $T_C$. About 5–10 hours at 100° C. below $T_C$ is sufficient to produce ordered structure.

Figure 2:
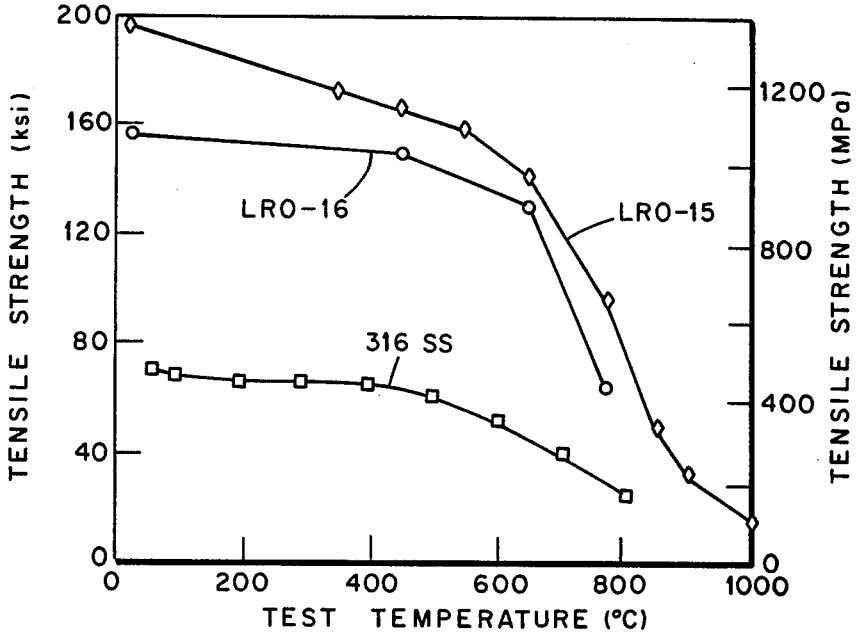
FIG. 2 is a graph showing the ultimate tensile strength of alloys of this invention as compared to type 316 stainless steel.
Figure 3:
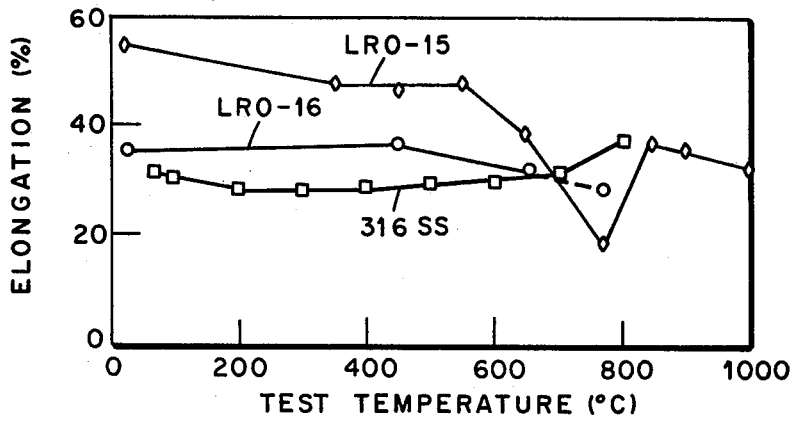
FIG. 3 is a graph showing the tensile elongation of alloys of this invention as compared to type 316 stainless steel.

Table III shows the room temperature tensile properties of LRO-15, -16, and -17 in both the ordered and disordered states. The formation of long range ordering significantly increases the work hardening rate and the tensile strength but only slightly affects the yield strength. Each alloy is ductile and had about 35–55% elongation in the ordered state. FIG. 1 depicts the yield strength as a function of test temperature of LRO-15 and -16. It is seen that the yield strength increases substantially with test temperature above 300° C. and reaches a maximum around $T_C$. The yield strength shows a drop above $T_C$ due to the disordering effect. Nevertheless, the alloy is still significantly stronger than type 316 stainless steel even at a temperature above $T_C$. The peaks in yield strength in LRO-15 and -16 occur at lower temperatures than for LRO-1 and LRO-3 of U.S. Pat. No. 4,144,059. LRO-1 had a composition by weight of about 16% Fe, 23% V and the remainder Co. LRO-3 had a composition of 25% Fe, 23% V and the remainder Co. FIG. 2 depicts the tensile strength of LRO-15 and 16 as a function of test temperature. The tensile strength is seen to decrease gradually with temperature until approximately $T_C$, then reducing at a greater rate with temperature. FIG. 3 is a comparison of tensile elongation of LRO-15 and -16 as a function of test temperature. It is seen that both LRO alloys demonstrate elongations greater than that of type 316 stainless steel until temperatures around $T_C$ are reached. LRO-15 exhibits a ductility minimum around 780° C., probably related to a change in the ordered state around $T_C$.

As shown in FIGS. 1–3, LRO-16 and LRO-15 demonstrate improved mechanical properties at lower temperatures than do the Co-based LRO-1 and -3 alloys. An alloy of this invention particularly useful at temperatures less than 650° C. is the composition having LRO-16 as midrange. This composition comprises by weight 22–23% V, 28–33% Ni, and the remainder Fe, and, as shown in FIGS. 1–3, will demonstrate a yield strength of at least about 400 MPa over the temperature range from room temperature to about 650° C. An alloy demonstrating high ductility and exceptionally high yield strength up to about 800° C. is the alloy having LRO-15 as midrange. This alloy comprises by weight 22–23% V, 19–22% Ni, 19–22% Co and the remainder Fe, and as shown by FIGS. 1–3, will demonstrate a yield strength over the temperature range of 650°–750° C. of at least about 450 MPa and a room temperature tensile elongation in the ordered state of at least about 45%.

Creep properties of the ordered alloys were determined at 650° C. and 276 MPa in vacuum under a deadload arrangement. Table IV shows the creep rate and rupture life of ordered and annealed LRO-15, -16, and -17 in comparison with type 316 stainless steel. It is seen that the minimum creep rate is approximately 3 orders of magnitude lower for than type 316 stainless steel. The ordered alloys of this invention did not rupture after 1000 hours.

TABLE I

| Alloy | Nominal Composition | e/a | Ordered Structure | $T_C$ (°C.) |
|---|---|---|---|---|
| LRO-18 | $Fe_3V$ | 7.25 | disordered | — |
| LRO-16 | $(Fe_{61}Ni_{39})_3V$ | 7.835 | ordered, γ',FCC | 670 |
| LRO-17 | $(Fe_{52}Co_{10}Ni_{38})_3V$ | 7.895 | ordered, γ',FCC | 700 |
| LRO-15 | $(Fe_{48}Co_{27}Ni_{25})_3V$ | 7.828 | ordered, γ',FCC | 760 |
| LRO-19 | $Co_3V$ | 8.00 | ordered, κ, HCP | 1070 |

TABLE II

| Alloy Designation | Composition, wt. % | | | |
|---|---|---|---|---|
| | V | Fe | Ni | Co |
| LRO-16 | 23 | 46 | 31 | 0 |
| LRO-15 | 23 | 36 | 20 | 21 |
| LRO-17 | 23 | 39 | 30 | 8 |

TABLE III

| Alloy | State | Strength, MPa | | Elongation |
|---|---|---|---|---|
| | | Tensile | Yield | |
| LRO -15 | Disordered | 881.2 | 394.1 | 51.1 |
| -15 | Ordered | 1329.1 | 354.2 | 54.7 |
| LRO -16 | Disordered | 858.5 | 392.7 | 48.0 |
| -16 | Ordered | 1070.7 | 423.1 | 35.2 |
| LRO -17 | Disordered | 711 | 305 | 61.6 |
| -17 | Ordered | 1085 | 287 | 50.1 |
| LRO -18 | Disordered | 594 | 440 | 22.0 |
| -18 | Aged | 600 | 460 | 6.6 |

TABLE IV

| Alloy | Min. Creep Rate (cm/cm/hr) | Rupture Life (hr) |
|---|---|---|
| LRO-15[a] | $2 \times 10^{-6}$ | c |
| LRO-17[a] | $4 \times 10^{-6}$ | c |
| LRO-16[a] | $9 \times 10^{-6}$ | c |
| 316 SS[b] | $1 \times 10^{-2}$ | 20 |

[a]Specimens were in ordered and annealed condition
[b]Specimens were in annealed condition
[c]Test was stopped after 1000 hr.

What is claimed is:

1. A long range ordered alloy composition having a critical ordering temperature greater than 600° C., a room temperature ultimate tensile strength greater than about 1000 MPa, and a room temperature tensile elongation in the ordered state greater than about 30%, said alloy having the nominal $V(Fe,Ni)_3$ or $V(Fe,Ni,Co)_3$ composition and comprising by weight 22–23% V, 35–50% Fe, 0–22% Co and 19–40% Ni with an electron density no greater than 8.00.

2. The ordered alloy composition of claim 1 consisting essentially of by weight 22–23% V, 35–50% Fe, 0–22% Co, and 19–40% Ni.

3. The ordered alloy composition of claim 1 consisting of by weight 22–23% V, 35–50% Fe, 0–22% Co, and 19–40% Ni.

4. The ordered alloy composition of claim 1 comprising by weight 22–23% V, 35–45% Fe, 0–10% Co, 25–35% Ni.

5. The ordered alloy composition of claim 1 comprising by weight 22–23% V, 28–33% Ni, and the remainder Fe, and having a yield strength at least about 400 MPa over the temperature range from room temperature to about 650° C.

6. The ordered alloy composition of claim 1 comprising by weight 22–23% V, 19–22% Ni, 19–22% Co and the remainder Fe, and having a yield strength over the temperature range of 650°–750° C. of at least about 450 MPa and a room temperature tensile elongation in the ordered state at least about 45%.

7. The ordered alloy of claim 1 having an electron density greater than 7.85.

8. A wrought or drawn article of manufacture in the form of plate, sheet, rod, wire, foil and the like having the composition of claim 1.

9. In an apparatus having a structural component exposed to a temperature greater than 300° C., the improvement in which said component comprises the alloy of claim 1.

10. A method for fabricating articles from the alloy of claim 1 comprising deforming said alloy at a temperature above the critical ordering temperature of said alloy to provide a wrought article and annealing said wrought article for a sufficient time to provide long range ordered structure in said wrought article.

11. A method for fabricating articles from the alloy of claim 1 comprising deforming said alloy at a temperature below the critical ordering temperature of said alloy to provide a wrought article and annealing said wrought article for a sufficient time to provide long range ordered structure in said wrought article.

* * * * *